United States Patent [19]

Hills et al.

[11] 4,225,055

[45] Sep. 30, 1980

[54] INSULATION FOR DOUBLE WALL TANKS

[75] Inventors: Richard E. Hills, Coraopolis; Derek K. Neely, Pittsburgh, both of Pa.

[73] Assignee: Pittsburgh-Des Moines Steel Company, Pittsburgh, Pa.

[21] Appl. No.: 60,602

[22] Filed: Jul. 27, 1979

[51] Int. Cl.[3] ..... B65D 90/04

[52] U.S. Cl. ..... 220/452; 220/432; 220/435

[58] Field of Search ..... 220/1.5, 426, 429, 450, 220/452, 901, 431, 432

[56] References Cited

U.S. PATENT DOCUMENTS 3,010,599 11/1961 Haines, Jr. et al. ..... 220/452

3,339,778 9/1967 Herrenschmidt ..... 220/452

*Primary Examiner*—George T. Hall

*Attorney, Agent, or Firm*—Shoemaker and Mattare, Ltd.

[57] ABSTRACT

A system of insulation for double wall tanks includes a plurality of insulation layers held on the outside of an inner wall of the double wall tank by a plurality of orthogonally arranged bands. The bands include bands oriented longitudinally of the tank and bands oriented laterally of the tank. The insulation layers include abutting units, with each unit having a facing sheet thereon. The outermost insulation layer has abutting units with overlapping facing sheets, and the insulation layers assume a quilted pattern.

16 Claims, 7 Drawing Figures

172
174
176
C
32
56
96
58
110
94
130
122
134
120
150
152
22
18
76
72
92
90
82
84
86
94
96
78
170
180
178
190
188
186
192
194
196
198

INSULATION FOR DOUBLE WALL TANKS

BACKGROUND OF THE INVENTION

The present invention relates in general to storage tanks, and, more particularly, to insulated storage tanks.

In the petroleum and chemical industries it is customary to store liquids and the like within large tank structures which are usually installed out in the open where they are exposed to the elements, both heat and/or cold. These storage facilities must be provided with a suitable insulating material so that the products in storage within the storage tanks may be kept at the desired temperatures. In previous storage tank insulation, it has been customary to apply some type of an insulating material exteriorly of the metallic tank structure and to securely bind the same thereto by the use of an adhesive or by circumferential bands extending completely around the outside diameter of the tank and secured in a fixed position. The manner of securing insulating panels to the exterior of a metallic storage tank is objectionable for the reason that the tank structure is oftentimes exposed to varying temperature gradients with the result that the metallic shell is caused to expand and contract due to such temperature variations. Obviously, if an insulating material has been applied to the exterior surface of such a tank as by adhesively securing the same thereto, the adhesive bond between the metallic shell and insulating material is caused to be broken due to such expansion and contraction with the result that the insulating material is separated from the metallic shell with resultant loss of insulation for the tank at such spots or areas. In instances where the insulating material is secured to the tank structure as by means of exteriorly extending circumferential bands, the bands are usually set to a pretensioned force at the time of installation of the insulating material and when, by reason of differing temperature gradients, the tank walls are caused to expand and/or contract, the bands, which are usually formed of metal, are incapable of further stretching to accommodate the expansion of the tank and insulating material thereon and will break or snap off, thus necessitating the repair or replacement of such bands. On the other hand, where the tank structure is caused to contract, the metallic bands lose their efficiency as holding means for the insulating material since the bands are not exposed to the temperatures within the tank which causes such contraction of the metallic tank.

There have been devices disclosed directed to overcoming problems associated with such storage facilities. One solution has been proposed in U.S. Pat. No. Re. 27,330, and other insulated tanks are disclosed in U.S. Pat. Nos. 3,010,599, 2,980,279, 4,146,952, 4,122,640, 4,044,517 and 3,993,213. Double wall tanks are disclosed in U.S. Pat. Nos. 3,612,332 and 3,935,957.

However, none of these known structures provides adequate support for tank insulation in all directions, that is both longitudinally and laterally of the tank. Furthermore, none of the known structures protects against gas movement through the insulation in a manner which is thoroughly effective.

Thus, there is need for a system of tank insulation which is securely supported in all directions, and which is effectively sealed against gas movement through that insulation.

SUMMARY OF THE INVENTION

The system of insulation disclosed herein is supported longitudinally and laterally on a tank and has overlapping joints which effectively prevent convection at those joints.

A double wall tank includes an outer wall of concrete or the like, and an inner wall of structural steel, or the like. An annular space is defined between the two walls.

Insulation, which is preferably fibrous type insulation, is supported on the outer surface of the inner wall. The insulation includes a plurality, preferably two, of overlying layers of insulation blankets each having a facing sheet on one side thereof. The blankets include a plurality of edge-abutting units, and the outer blanket units have facing sheets wider than the units. The facing sheets of abutting units in the outer blanket thus overlap at the joints to occlude those joints.

An orthogonal matrix of bands circumscribes the tank. The matrix includes vertically oriented bands and horizontally oriented bands. Spring loaded coupling members similar to those clamps disclosed in U.S. Pat. No. Re. 27,330 are used to couple the ends of the horizontally oriented bands together.

Coupling members are used to connect the ends of the vertically oriented bands to the top and bottom of the tank. Coupling members include clamps similar to the just-mentioned clamps disclosed in U.S. Pat. No. Re. 27,330, and a further member which is similar to the U.S. Pat. No. Re. 27,330 member, but without spring means.

When the bands are in place on the tank, the insulation held thereon by those bands assumes a quilted pattern by being pressed down by the bands, but being unconstrained in such a manner between the bands.

The bands can be oriented over the joints formed at adjacent insulation units to further occlude those joints and thus further prevent passage of any gas through such joints.

Keepers are placed on the vertical bands to further support the horizontal bands.

OBJECTS OF THE INVENTION

It is, therefore, a main object of the present invention to insulate a double wall tank in a manner which securely supports insulation in all directions.

It is another object of the present invention to insulate a double wall tank in a manner which effectively prevents gas movement within the insulation.

These together with other objects and advantages which will become subsequently apparent reside in the details of construction and operation as more fully hereinafter described and claimed, reference being had to the accompanying drawings forming part hereof, wherein like reference numerals refer to like parts throughout.

DETAILED DESCRIPTION OF THE INVENTION

Figures 1, 3:
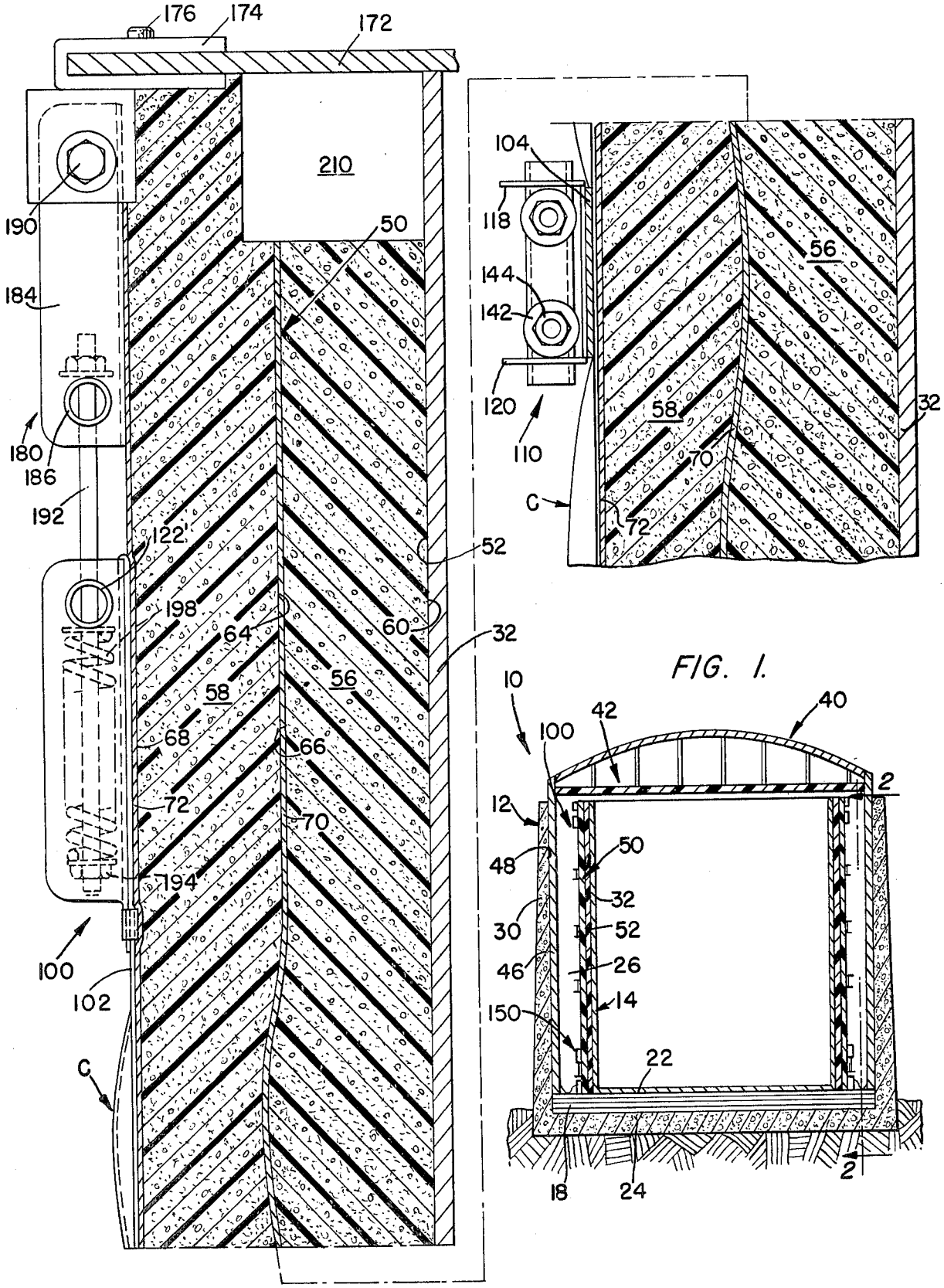
FIG. 1 is an elevation view of a double wall tank which includes an insulation system embodying the teachings of the present invention.
FIG. 3 is a view taken along line 3—3 of FIG. 2.

Shown in FIG. 1 is a double wall tank 10 which includes an outer tank 12 formed of concrete or the like, and an inner tank 14 formed of steel or the like to be structurally self-sufficient. The tank 10 is supported on a foundation, and insulation 18 is in a position between bottom 22 of inner tank 14 and bottom 24 of outer tank 12. An annular space 26 is defined between walls 30 and 32 of tanks 12 and 14, respectively. Insulation such as Perlite, or the like, can be located in the annular space, if suitable. However, the preferred embodiment of the present invention has the annular space free of granular insulation. A dome roof 40 is attached to outer tank 12, and a suspended deck 42 is included in the tank 10.

Other double integrity tanks can be used without departing from the scope of the present disclosure, and it is noted that the tank shown in FIG. 1 is intended to be an example only, and is not intended to be limiting.

Insulation 46, such as polyurethane, polystyrene foam, wood, or other such suitable insulation, is located on inner surface 48 of outer tank wall 30. Insulation system 50 is located on outer surface 52 of inner tank wall 32. The insulation system 50 is the subject of the instant disclosure, and will be more fully discussed hereinafter with reference to FIGS. 2–7 inclusively.

As best shown in FIG. 3, the insulation system 50 includes inner and outer insulation blankets 56 and 58, with the blanket 56 having an inner face 60 contacting the outer surface 52 of the tank wall 32, and outer blanket 58 having an inner face 64 contacting the inner blanket 56. Outer faces 66 and 68 of the blankets 56 and 58, respectively, are covered by facing layers 70 and 72, respectively. Facing layers can include aluminum foil/-scrim, or the like, and serve to minimize gas movement within the insulation system.

It is here noted that while two layers of insulation are shown, more than two layers of insulation, or less than two layers of insulation, can be used without departing from the scope of the present invention.

Figures 4, 5, 6, 7:
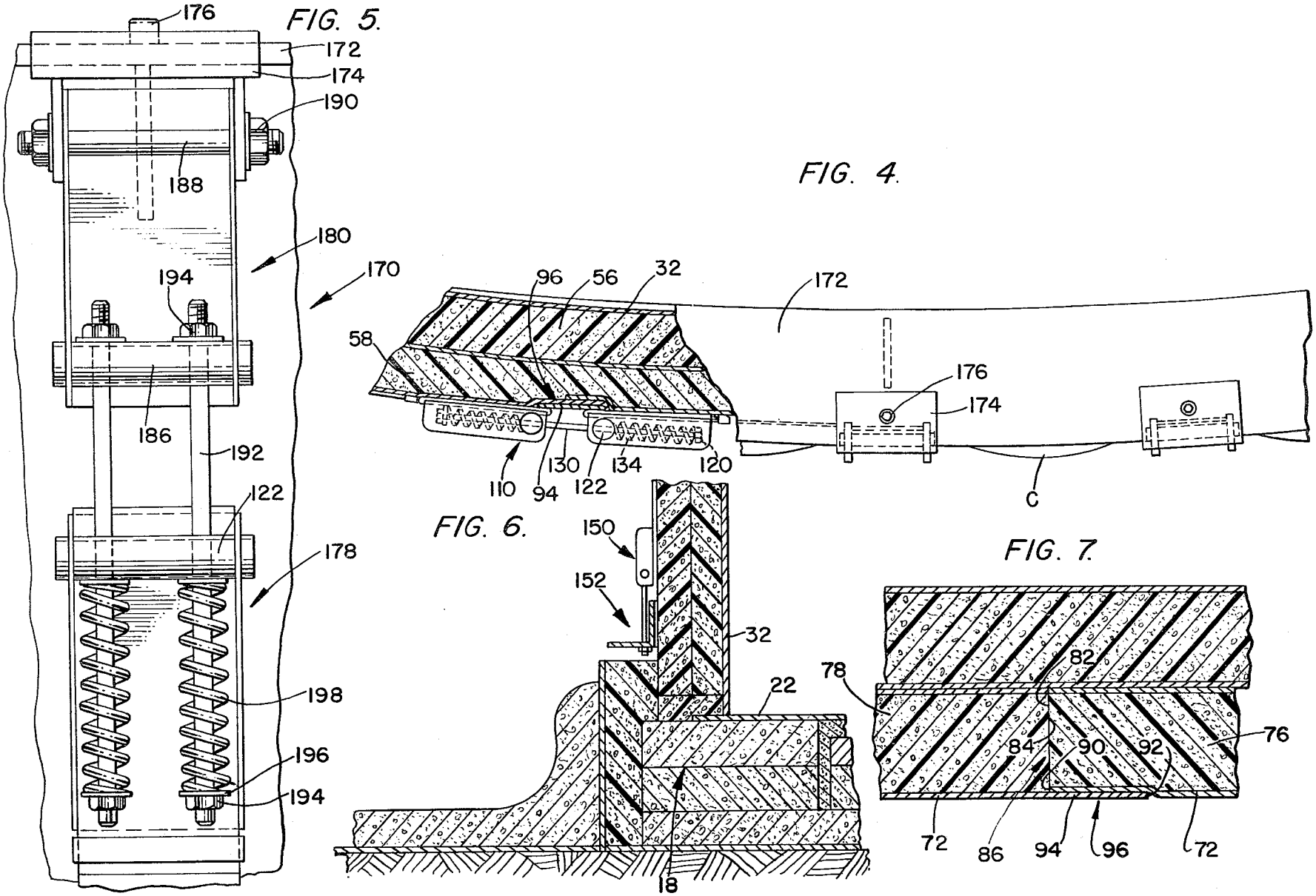
FIG. 4 is a view taken along line 4—4 of FIG. 2.
FIG. 5 is an elevation view of a coupling member used in the system of insulation embodying the teachings of the present invention.
FIG. 6 is a partial elevation view of a portion of a double wall tank which includes a system of insulation embodying the teachings of the present invention.
FIG. 7 is a view of a portion of the insulation system embodying the teachings of the present invention.

As best shown in FIG. 7, the outer insulation blanket, which in one embodiment is co-extensive with the tank, includes a plurality of discrete units, such as units 76 and 78 which have abutting longitudinal side edges 82 and 84, respectively. The inner insulation blanket is likewise comprised of a plurality of discrete units in edge abutting contact. The joints on the inner and outer blanket units are staggered to preclude formation of a convection heat transfer path through the insulation blankets. Thus, FIG. 7 shows only joint 86 formed by units 76 and 78, but it is understood that the preferred embodiment of the present invention includes a plurality of edge-abutting units in inner insulation layer 56 as well. The insulation units can be co-extensive or not as suitable. Insulation blankets are selected according to the requirements of the tank 10. For example, in the case of ethylene storage tanks, where the liquid is at −155° F., it is necessary to provide approximately six inches of 1 lb. per cu. ft. density fiberglass for system 50. It is also noted that while two layers of insulation are shown and preferred, more layers can be used without departing from the scope of the present disclosure. The insulation layers can also be co-extensive with the tank height, but need not be in this invention.

As shown in FIG. 7, the facing layers 72 of the outer insulation blanket are positioned on the units to have one longitudinal edge 90 coincident with one edge of the unit, and the other longitudinal side edge 92 extending outwardly therefrom to form an overhanging element 94. As shown in FIG. 7, the overhanging element 94 of one unit overlaps the next adjacent unit to form a facing layer lap joint 96. These lap joints occlude the joints 86 to prevent formation of any continuous convection paths through the insulation blanket 58. Similar facing layer lap joints are formed by the facing layer 70 to define occluding means for the joints formed of the inner blanket units.

The facing sheet on the outer blanket also extends beyond one end edge of the units as well. Thus, if the units are vertically abutting, the lower facing sheet overlaps the upper unit to form a lap joint similar to lap joint 96.

Figure 2:
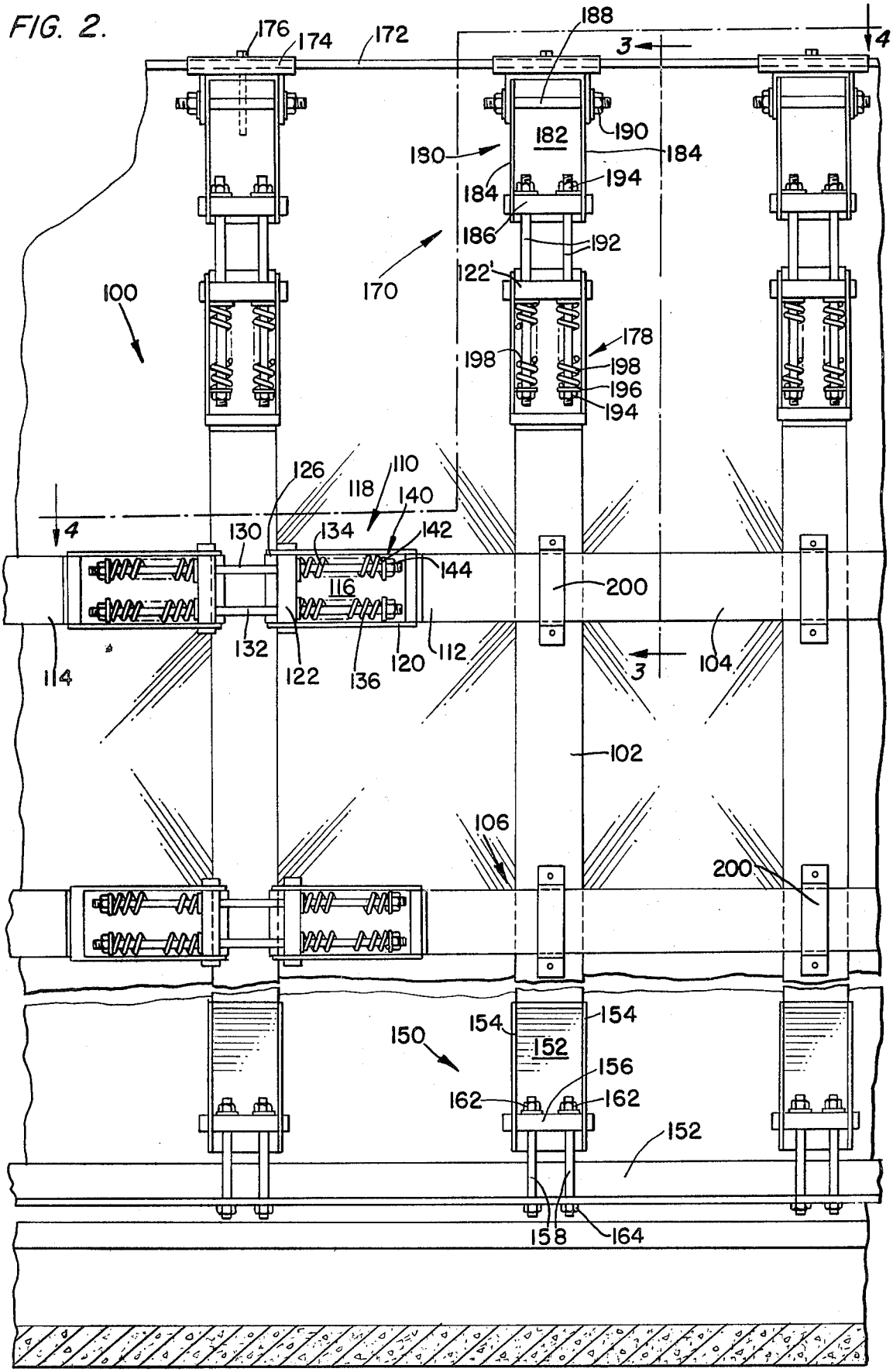
FIG. 2 is a view taken along line 2—2 of FIG. 1.

As best shown in FIGS. 1 and 2, a harness system 100 circumscribes the inner tank 14. The harness system supports the insulation system 50 on the inner tank outer surface, and includes a plurality of longitudinally extending straps or bands 102 and a plurality of laterally extending straps or bands 104. The bands are arranged in an orthogonal matrix and longitudinal and lateral bands are essentially perpendicular with respect to each other and intersect at locations such as intersection 106. It is noted that the bands are located to cover any of the facing layer joints, such as lap joints 96, to further occlude any potential convection path through the insulation system 50.

As best shown in FIG. 2, the lateral bands are each closed by a spring loaded clamp member 110 which attaches one end 112 of the band to the other end 114 of that same band. The clamp member 110 is preferably the same clamp member as disclosed in U.S. Pat. No. Re. 27,330, and the disclosure of that patent is fully incorporated herein by reference thereto. Each of the clamping members 110 includes a base 116 affixed to the band, a pair of upstanding side ears 118 and 120 mounted on the longitudinal side edges of the base, and a tubular cross-piece 122 mounted on the ears to extend transversely across the base at one end 126 thereof. A pair of rods 130 and 132 are mounted on the cross-pieces and extend toward both ends of the base. Springs such as springs 134 and 136 are mounted on the rods above base 116 and are held thereon by spring retainers 140. The spring retainers include washers 142 and bolts 144 mounted on threads 146 defined on the end of the rod. As shown in FIG. 2, the clamping members are paired and thus the above description of one clamping member applies equally to the other member of the pair of clamping members.

The rods extend through the cross-pieces of the paired clamping members and springs are mounted on both ends of each rod to thereby couple together the clamping members of each pair of clamping members, thereby coupling the ends of a band together.

By suitably adjusting the spring retainers, the proper amount of tension can be established on each band 102. The springs accommodate movement of the band while maintaining the desired amount of tension in the band.

As best shown in FIG. 2, the vertical bands 102 extend from the near the bottom of the tank to near the top of the tank. Coupling members 150 connect the ends of the vertical bands to a continuous roll angle mount 152 surrounding the tank near the bottom thereof. The coupling members 150 are similar to the clamping members and each comprises a base 152 having a pair of upstanding ears 154 on the longitudinal edges thereof. A cross-piece 156 is mounted on the ears and extends transversely across the base near one end thereof. A pair of rods 158 have threaded ends and are connected at one end to the cross-piece by bolts 162 and at the other end to the angle mount by bolts 164.

Upper coupling members 170 connect the upper ends of the vertical bands to a rim girder 172 located on top of the tank via a bracket 174 which is affixed to the rim girder by a fastener 176. The upper coupling members 170 each includes a spring clamp member 178 which is identical to the spring clamp coupling member 110. The clamp member 178 is affixed to the band upper end as shown in FIGS. 2 and 5. Coupling attaching members 180 couple the clamp members 178 to the rim girder. Each member 180 includes a base 182 and a pair of upstanding ears 184 located on the longitudinal edges thereof. A cross-piece 186 extends transversely across the base near one end of the base, and a second cross-piece 188 extends transversely across the base at the other end of the base. The second cross-piece is attached to the ears by fasteners such as bolts 190, or the like. A pair of rods 192 have threaded ends and bolts 194 are mounted on the ends of these rods. Washers 196 are mounted on one end of each of the rods, and springs 198 surround the rods and are mounted between the cross-piece 122' and the washers. The other ends of the rods are held by bolts and washers to the cross-piece 186 of the member 180, thereby connecting the band to the rim girder.

The springs 198 maintain a desired amount of tension on the bands 102 while permitting some expansion and contraction. Keepers 200 are mounted on the longitudinal bands and the lateral bands are held therein at the intersection of the bands.

As best shown in FIG. 3, a gusset plate 210 is included in the tank 10.

As best shown in FIG. 4, when the bands are tightened down, the insulation blankets deform into a quilted or waffle configuration with crowns C appearing between the bands.

In installation, the insulation blankets are brought into the tank in rolls, and placed at the top of the inner tank on the suspended deck. The coils of insulation are unrolled and the blanket is temporarily suspended in the annular space from attachments, such as adhesives or pins, or the like. This attachment is located near the top of the inner tank. Of course, the inner layer is placed first, and then the outer layer follows. After all of the blankets are suspended, it is necessary to fasten the blankets to the tank shell so that there are no gaps between the blanket and the tank shell, and so that there are no openings between the blankets, and specifically so that any vertical joints in the outer layer of insulation are closed.

As shown in FIG. 7, the facers on the outer blanket units are preferably 1½ inches wider than the blanket units. This forms overlap 94 which is merely placed over the facer on the adjacent blanket unit, thus forming a mechanical closure 96 for the joints. This overlap joint can also be formed on the inner blanket as well. The overlap occurs in the vertical as well as the horizontal joints, if any, of both layers of the blanket.

After the two layers of blanket have been installed, bands are then placed to permanently support the blanket against the tank shell. This is done by first placing vertical bands 102. These vertical bands preferably are placed on 4 foot centers over the joints in the outer layer of insulation. As shown in FIG. 4, a joint in the outer blanket layer has a vertical band thereover. The vertical banding is intended to further close the vertical joints in the insulation system. After the vertical bands are installed, they are pre-tensioned to pre-compress the blanket in the area underneath the vertical bands approximately equal to the amount the inner tank will shrink as the product is introduced thereto.

The amount of shrinkage of the inner tank varies with the size of the tank and the temperature of the installed liquid. For a typical tank, this shrinkage is in the range of ½ to 1½ inches on the radius of the tank. For a specific ethylene tank, the amount of inner tank shrinkage is about ⅝ inches on the radius. Therefore, the band mountings are positioned at the top and bottom ends inwardly to pre-compress the blanket about ⅝ inches, and then the bands are tensioned so that the blanket is pulled tightly against the shell over the full height of the bands.

After the vertical bands are in place and pretensioned, the horizontal bands are positioned. The horizontal bands are preferably located at about 4 foot intervals vertically up the side of the tank. The horizontal bands include spring assemblies preferably spaced at about 30 foot intervals around the circumferance of the tank. The positioned, horizontal bands are brought to a snug condition, and the spring assemblies are tightened to again pre-compress the blanket in the area underneath the bands an amount equal to the shrinkage expected on the inner tank.

Once the bands have been installed and tightened, keepers 200 are placed across the horizontal bands where the horizontal and vertical bands intersect. One of these keepers will be placed at each intersection. The purpose of the keepers is to keep the horizontal bands from sliding vertically under their own weight should these bands become loose. Also, the weight of the horizontal bands is thereby transferred to the vertical bands. The weight of the blanket is ultimately carried by the vertical bands because of the friction within the band assembly.

The resulting exterior appearance of the blanket is the quilted design indicated in FIGS. 2 and 4. That is, the outer blanket is compressed underneath the bands and not compressed in the area between the bands.

After the bands have been installed, pre-compressed and the keepers installed, the tank is ready for cool-down. In the specific case of the ethylene tank, the inner tank cools to −155° F. The annular space, however, cools to −43° F. If it is assumed that the tank was erected at +70° F., the inner tank goes through a temperature change of 225° F., whereas the annular space goes through a change of 113° F. The inner tank is manufactured steel with a coefficient of expansion of about one-half that of aluminum. The bands, when these bands cool, shrink, but they are manufactured of aluminum in the preferred embodiment. Therefore, the relative shrinkage of the bands with respect to the inner tank is approximately balanced. The bands, with greater coefficient of thermal shrinkage, experience less temperature decline that does the tank with its lesser coefficient. Therefore, the banding system will remain as initially installed for all practical purposes.

The springs allow for makeup of any inconsistencies within the system, such as differential temperatures over the height of the tank, and the annular space, or the like.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bounds of the claims or that form their functional as well as conjointly cooperative equivalents are, therefore, intended to be embraced by those claims.

We claim:

1. Insulation means for a tank comprising: a first fibrous insulation layer on a wall of a tank;

insulation supporting means supporting said insulation layer on the tank wall, said insulation supporting means including a plurality of longitudinal bands vertically oriented and attached to the tank wall, and a plurality of lateral bands horizontally oriented to surround the tank wall, said supporting means holding said insulation layer in place on the tank wall.

2. The insulation means defined in claim 1 further including a second fibrous insulation layer on said first fibrous insulation layer.

3. The insulation means defined in claim 2 wherein said first insulation layer has a first facing sheet on one face thereof and said second insulation layer has a second facing sheet on one face thereof.

4. The insulation means defined in claim 1 further including coupling means attaching said longitudinal bands to the tank wall, and clamping means attached to said lateral bands.

5. The insulation means defined in claim 4 wherein said coupling means and said clamping means include spring loaded members.

6. The insulation means defined in claim 1 further including keepers mounted on said longitudinal bands for connecting said lateral bands to said longitudinal bands.

7. The insulation means defined in claim 3 wherein said first insulation layer includes a plurality of abutting first units, and said second insulation layer includes a plurality of second units.

8. The insulation means defined in claim 7 wherein each of said first units includes a first facing sheet, and each of said second units includes a second facing sheet.

9. The insulation means defined in claim 8 wherein said second facing sheets are larger than said second units so that second facing sheets of abutting second units overlap each other.

10. The insulation means defined in claim 9 wherein said longitudinal bands are positioned to coincide with joints formed by abutting second units.

11. The insulation means defined in claim 9 wherein joints formed by abutting second units are staggered with respect to joints formed by abutting first units.

12. The insulation means defined in claim 5 wherein said coupling means each further includes a second coupler attached to said spring loaded members.

13. The insulation means defined in claim 3 wherein said insulation layers define a quilted pattern.

14. The insulation means defined in claim 5 further including a rim girder on top of the inner tank wall and an angle mount on the inner tank wall near the bottom thereof, said coupling members being attached to said rim girder and to said angle mount to attach said longitudinal bands to the tank inner wall.

15. The insulation means defined in claim 1 wherein the tank is a double wall tank which includes an outer wall and an inner wall with said insulation being positioned on the outside of said inner wall.

16. The insulation means defined in claim 15 wherein the inner tank wall includes steel with a first coefficient of expansion and said bands include aluminum with a second coefficient of expansion, said first coefficient of expansion being approximately one-half of said second coefficient of expansion so that upon cooling of the tank, relative shrinkage of said bands with respect to the inner tank wall is approximately balanced.

* * * * *